US005528987A

United States Patent [19]

Andersson et al.

[11] Patent Number: 5,528,987

[45] Date of Patent: Jun. 25, 1996

[54] ROTARY PRINTING PRESS UNIT SUSPENDED FROM BEAM FRAME

[75] Inventors: Ingvar Andersson, Löddeköpinge; Bengt Hersenius, Genarp, both of Sweden

[73] Assignee: Tetra Laval Holdings & Finance S.A., Sweden

[21] Appl. No.: 385,103

[22] Filed: Feb. 7, 1995

[30] Foreign Application Priority Data

Feb. 9, 1994 [SE] Sweden ..... 9400422

[51] Int. Cl.[6] ..... B41F 5/04

[52] U.S. Cl. ..... 101/219; 101/152; 101/174; 101/479; 101/DIG. 35

[58] Field of Search ..... 101/152, 174, 101/175, 176, 178, 179, 180, 181, 183, 216, 212, 219, 213, 221, 479, 480, DIG. 35

[56] References Cited

U.S. PATENT DOCUMENTS

| | | | |
|---|---|---|---|
| 2,036,158 | 3/1936 | McGiehan | 101/181 |
| 2,460,504 | 2/1949 | Huebner | 101/479 |
| 2,637,270 | 5/1953 | Bamford | 101/219 |
| 3,972,283 | 8/1976 | Jennings | 101/216 |
| 4,046,070 | 9/1977 | Halley | 101/216 |
| 4,239,001 | 12/1980 | Kataoka | 101/152 |
| 4,766,809 | 8/1988 | Giori et al. | 101/152 |
| 5,060,569 | 10/1991 | Gladow | 101/216 |

*Primary Examiner*—Eugene H. Eickholt
*Attorney, Agent, or Firm*—James Ray & Associates

[57] ABSTRACT

A rotary printing press built on a frame structure in which printing units, normally mounted on a floor foundation, are instead suspended from the frame structure to minimize clutter in the vicinity of the printing press and simplify the operation of changing the printing units when a printing run is complete.

20 Claims, 5 Drawing Sheets

ROTARY PRINTING PRESS UNIT SUSPENDED FROM BEAM FRAME

CROSS-REFERENCE TO RELATED APPLICATIONS

The invention taught in this patent application is closely related to the invention taught in the co-pending patent application for: A PRINTING UNIT FOR A ROTARY PRINTING PRESS, filed Feb. 7, 1995, Ser. No. 08/385,037. This referenced patent application is being filed concurrently herewith and is assigned to the assignee of this invention. Additionally, the teaching of this patent application is incorporated herein by reference thereto.

TECHNICAL FIELD

The present invention relates to a rotary printing press, in which a web to be printed is arranged to be conducted via an impression cylinder and there to be imprinted by means of a printing unit.

BACKGROUND OF THE INVENTION

Traditional printing presses are built within frame-works standing on a floor. The printing presses are compact, the floor surfaces in and in the vicinity of the printing press are limited and cluttered with equipment, and the different cylinders within the printing press and its printing units are difficult to reach. Thus, such printing presses are very hard to work with for the printing personnel, especially when a change of printing order is required, and it becomes very hard to keep the area in and around the printing press clean.

THE INVENTION

In accordance with this invention, the printing press is instead built around a beam structure, from which the printing unit, and possibly other equipment is attached or suspended. The main advantage obtained is that the floor under the printing press becomes free, so that the printing personnel are more free to move around the printing unit and perform necessary tasks on the unit. Furthermore, the area can be maintained more tidy, and the cleaning in and around the printing press becomes very easy.

The beam structure may preferably be supported from a foundation (the floor) by means of pillars, but it may equally well be suspended from supporting portions of a building in which the printing press is located.

A further advantage is accomplished in that the printing unit is displaceable transversely to the beam structure, suspended from brackets or roller conveyors so that the printing unit can easily be removed horizontally from the printing press. Accordingly, such printing unit can be pulled out transversely for maintenance work and exchange of ink color or cylinders.

The printing unit preferably consists of a frame with cylinders, which are rotatably journalled therein and are arranged to be driven synchronously with the impression cylinder, when the printing unit is in printing position underneath the impression cylinder. In a preferred embodiment of the invention, the beam structure comprises two longitudinally disposed beams with crossbeams.

A rotary printing press for four-color printing has four printing units but can also have a fifth printing unit, if a dominating color ("house color") is often printed. According to the invention, the four or five printing units are all arranged under the beam structure.

The impression cylinders are rotatably journalled on or within the beam structure, which for their operation, is provided with an electric primary motor, longitudinal drive shafts and angle joints.

It has been said above that printing units can be pulled out transversely for maintenance work and exchange of cylinders and colors. If the beam structure is provided with a jib arrangement at each side, more than one set of printing units may be movably disposed transversely to the beam structure. Accordingly, one set of printing units can be active for printing in the printing press, while at the same time a second set is being prepared for the next consecutive printing order. Extremely short set-up times are obtained in this way. Each jib arrangement may be composed of a framework consisting of cross bars and a longitudinal beam.

The construction of the printing press on a beam structure does not only embrace the advantages associated with the hanging printing units as stated above, but further permits the web to be mounted on cylinders on the top side of the beam structure which can also be very short and simple with accompanying advantages, among them a high reliability of service and a small material waste.

BRIEF DESCRIPTION OF THE DRAWINGS

The invention will be further described below with reference to the attached drawings, in which.

DESCRIPTION OF PREFERRED EMBODIMENTS

Figure 1:
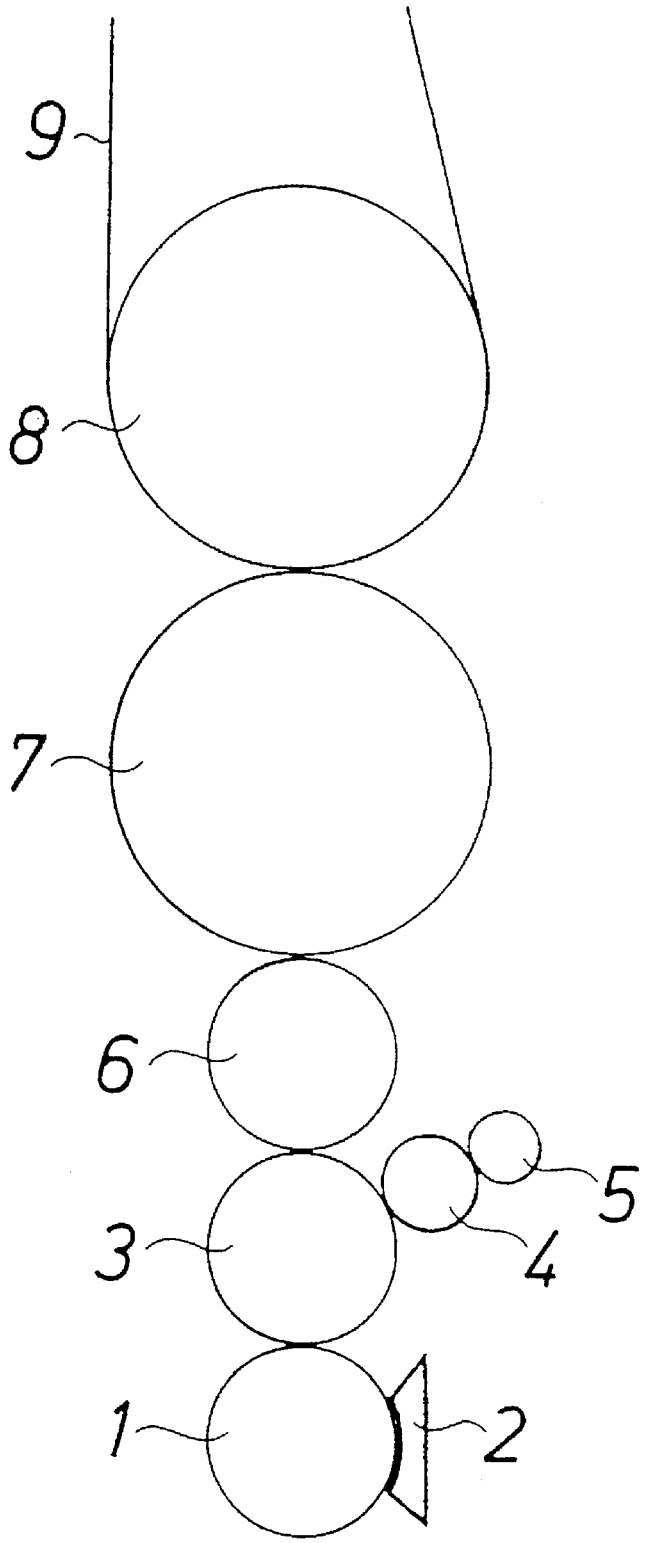
FIG. 1 is a schematic side view of a printing unit for a printing press according to the invention.

A printing unit for a rotary printing press is schematically shown in FIG. 1 having a number of cylinders described below, which are driven synchronously by a means not shown in FIG. 1, for example motor driven gearwheels (illustrated in FIG. 3). In the configuration illustrated in FIG. 1, the printing unit in a lowermost position has a screen cylinder 1 (often called anilox cylinder), which upon rotation picks up printing ink from a doctor chamber 2. The printing ink, which preferably has a very high viscosity, is deposited on the screen cylinder 1, which is provided with a very large number of small depressions for pickup of the printing ink on its entire peripheral surface.

From the screen cylinder 1, the ink is transferred to a form cylinder 3, which bears against the screen cylinder and rotates with the same speed and whose surface is somewhat elastic by virtue of being made of a ground rubber material. In order to accomplish a distribution of the ink on the form cylinder 3 which is as even as possible, an oscillating cylinder 4 (a polished steel cylinder) is in rotational engagement with the form cylinder 3, while a rubber cylinder 5, in turn, is in rotational engagement with the oscillating cylinder 4. In the preferred embodiment a fully satisfactory distribution of the ink on the form cylinder 3 is obtained by means of the two cylinders 4 and 5, but a greater number of ink distributing cylinders may of course be arranged in the vicinity of the form cylinder 3.

The next cylinder in the printing unit is a plate cylinder 6, on the periphery of which, a printing plate is disposed. At least a part of the periphery of the plate cylinder 6 is made of a magnetic metal material, while the thin and pliable printing plate has a metal base adhering to the periphery of the plate cylinder. A plastic layer is provided over the metal base of the printing plate, in which the desired printing pattern is worked out. Other ways of attaching the printing plate onto the plate cylinder 6 are possible, such as by mechanical or vacuum based techniques. The plate cylinder 6 bears against the form cylinder 3 and has the same peripheral speed. The screen cylinder 1, the form cylinder 3 and the plate cylinder 6 preferably have the same diameter.

From the plate cylinder 6, the print is transferred to a rubber blanket cylinder 7 (i.e. a rubber blanket covered steel cylinder), which is in contact therewith and has the same peripheral speed. Since the rubber blanket cylinder 7 preferably has twice the diameter as the plate cylinder 6 and thus twice the periphery, the rubber blanket cylinder is rolled two full impressions from the plate cylinder at each revolution. The rubber blanket cylinder 7 can alternatively have three or more times as big a diameter as the plate cylinder.

Finally, engaging the rubber blanket cylinder 7 is an impression cylinder 8, preferably with the same diameter as the former cylinder. A web 9 to be printed is rolled and pressed between these two cylinders. This web can be made of a paper material or any other suitable material for receiving print.

FIG. 1 is a schematic illustration of a printing unit. For purposes of simplifying the drawing, no journallings, drives or the like are shown. Further guidance with regard to such elements can be obtained from FIGS. 2 and 3 together with the description thereof.

By means of a printing unit as described above it is possible to obtain a printing process which can be said to be an intermediary between flexographic printing and offset printing. With flexographic printing, which is most suitable for the printing of single colored, large areas , use is made (apart from the impression cylinder) of a block cylinder engaging the web, and a screen cylinder cooperating with the block cylinder for receiving the ink. With offset printing, on the other hand, the process is more complicated with a greater number of cylinders and with a printing ink and fountain solution (on the non-printing portions of the plate). With the new printing process it is posible to obtain a printing quality which is very close to that which otherwise can only be obtained by offset printing.

Figure 2:
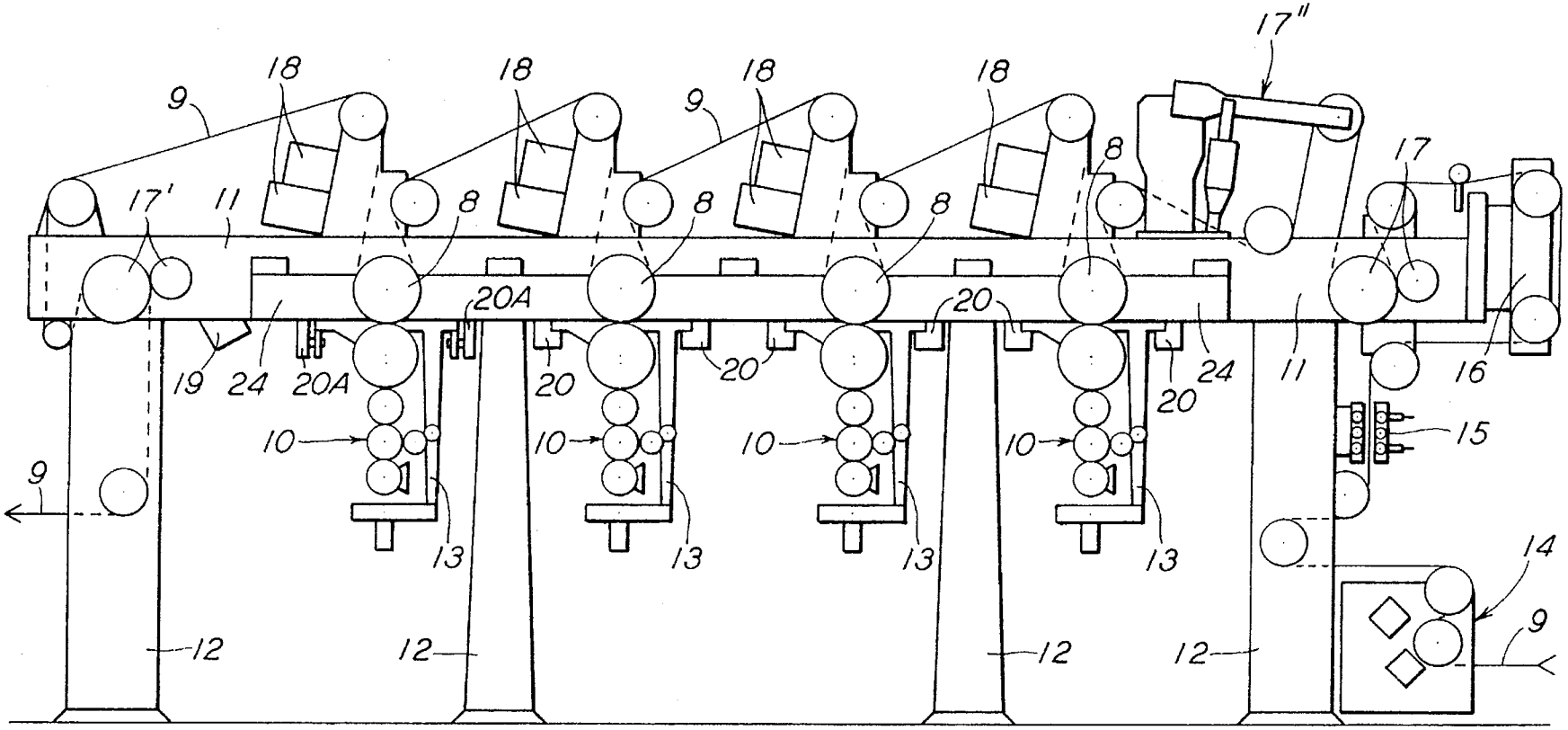
FIG. 2 is a schematic side view of a printing press according to the invention.

FIG. 2 is a side view of a rotary printing press. This printing press is provided with four printing units of the kind illustrated in FIG. 1 (or alternatively of some other kind). In each such printing unit, the impression cylinder 8, over which the web is conducted, is not herein regarded as included within the printing unit, and have been given the collective reference numeral 10. The reason why four units has been chosen is of course the traditional one, namely, that all printing colors can be obtained by means of the four colors yellow, bluish red (magenta), greenish blue (cyan) and black. In special cases, when a special color ("house color") is used to a large extent for printing, a fifth printing unit can be provided for this color.

Figure 4:
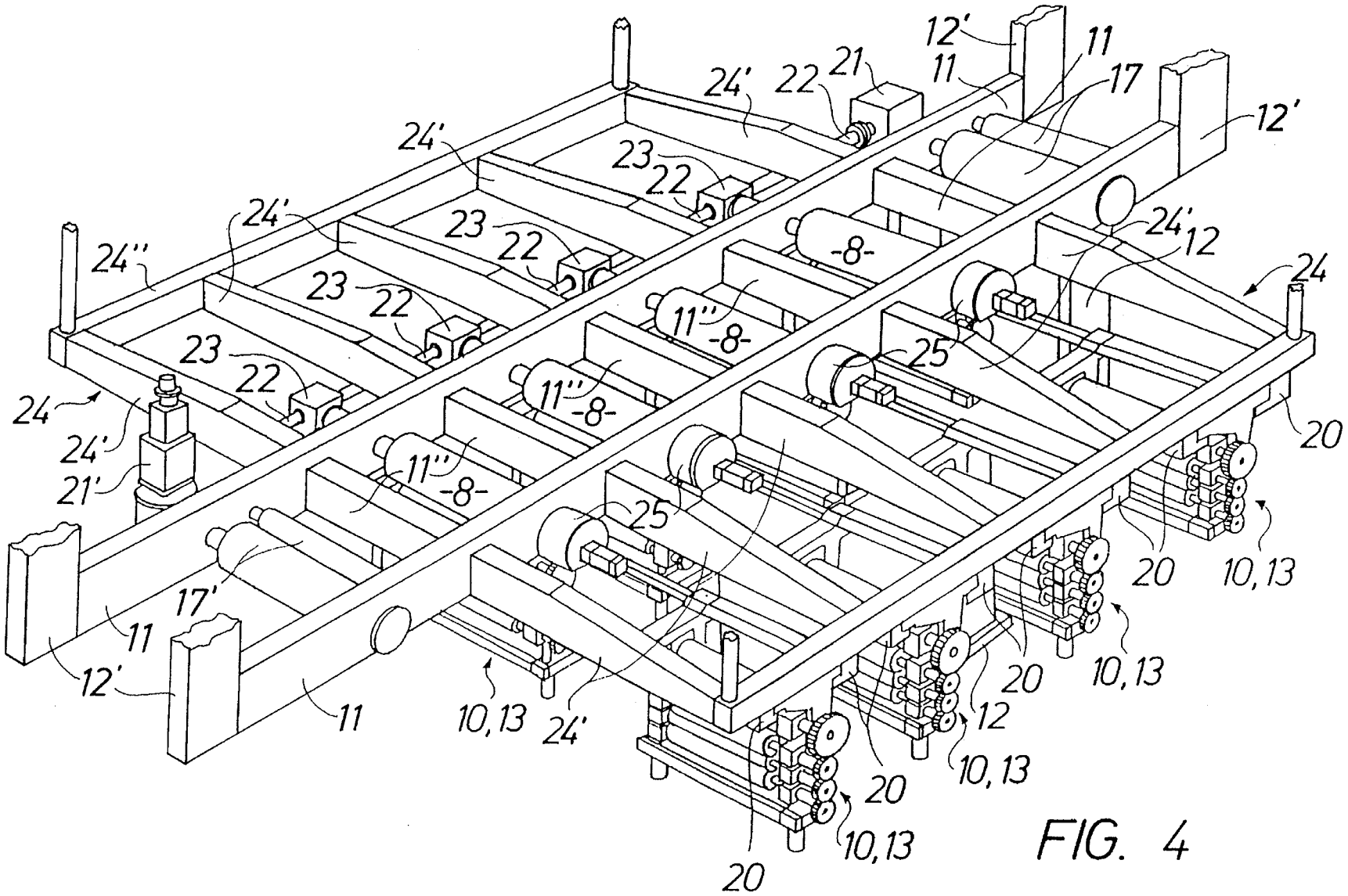
FIG. 4 is an isometric view of the printing press substantially as shown in FIG. 3 except that the printing press is supported from columns extending downwardly from an overhead structure (not shown)

A distinctive feature with the printing press according to FIG. 2 is that it is disposed on a strong beam structure 11, from which the printing units 10 are suspended, and on which in principle all other equipment, described below can be attached. This beam structure 11 can be supported on the floor by means of pillars 12 as shown in FIG. 2, but can in principle be suspended from the ceiling of a printers building from columns or beams 12' as shown in FIG. 4. The advantage with this construction is that the floor under the printing press is free for the operators and that the printing units and other equipment is extremely accessible.

Each printing unit 10 is mounted within a frame 13, which is suspended from the beam structure 11. Each printing unit 10 with its frame 13, which together can be called a cassette, can easily be dismounted and serviced or exchanged with a new cassette.

The web 9 enters the printing press at the right in FIG. 2, where it is first exposed to surface treatment at a treating unit 14 and thereafter cleaned in a cleaning unit 15. A lateral guiding arrangement 16 is disposed at the end of the beam structure 11 and accomplishes a lateral guiding and alignment of the web by turning the web around an axis parallel with the longitudinal axis of the beam structure 11. The web tension, which is essential for the function of the printing press and the quality of the print, is controlled by means of entrance nip cylinders 17 and exit nip cylinders 17', and also (if needed) a web tension arrangement 17" can be utilized, which consists of a tilting lever, which is controlled by means of a pneumatic cylinder and has a roller, over which the web 9 is conducted.

After having passed over the impression cylinder 8 in a printing unit, where the web 9 has been provided with printing in the form of an array of high viscosity printing ink, the web 9 passes a drying device 18. Normally, such a drying device 18, consists of UV-lamps, as the printing ink normally used is of the type hardened by means of UV-radiation. Alternatively, hot air drying or other drying techniques can be used.

When the web 9 has passed all printing units 10 in the printing press and provided with the desired four color-print, it can pass through an inspection system, for example, past a stroboscope lamp 19, so that an operator can check the printing quality, before the printed web 9 leaves the printing press at the left in FIG. 2.

The impression cylinders 8, over which the web 9 is conducted, are rotatably journalled in the beam structure 11, whereas the cylinders 1, 3–7 of each printing unit 10 are rotatably journalled in the frame 13. Upon an exchange of printing format, i.e. change of cylinder diameters, or possibly a change of printing ink, the printing unit cassettes 10, 13 can easily be removed from the printing press and be replaced with new cassettes. These new cassettes can be prepared during the previous run. With the inventive printing press as described above, the time lost at a cassette exchange becomes extremely short. Upon a cassette exchange the web 9 is further not affected, which minimizes the waste when cassettes are changed.

As shown in FIG. 2, the printing unit cassettes 10, 13 can be suspended from brackets 20 on the underside of the beam structure 11 and accordingly, can be pulled out laterally and manipulated, for example, with trolleys or a traverse.

The construction as described is very operator friendly and leaves the floor principally free. The suspended printing units with the ink storage (the doctor chambers 2) in the lowermost position is such that ink cannot pour over the equipment. As can be seen, the web path between the printing units can be very short and stable.

Figure 3:
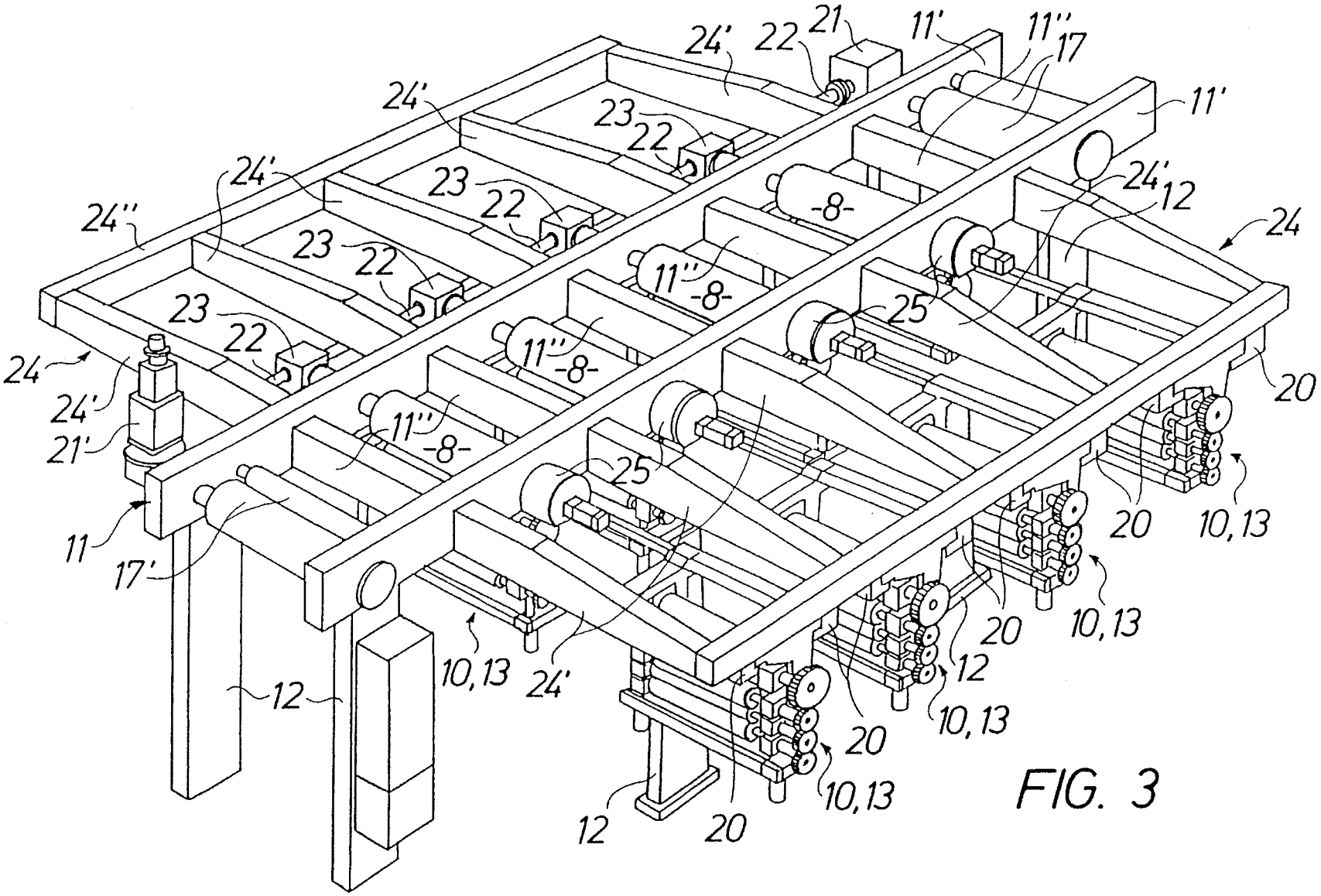
FIG. 3 is a view seen obliquely from above the printing press according to FIG. 2 with certain parts at the top side not shown for the sake of clarity.

In FIG. 3, where the printing press is shown in an oblique top view, the peripheral equipment on the top side of the beam structure 11 has not been shown in order that certain aspects of the design shall appear more clearly. As shown in FIG. 3, the beam structure 11 consists of longitudinal beams 11' and cross beams 11". The beam structure 11 is supported by the pillars 12 in the embodiment of FIGS. 2 and 3, and is supported from overhead beams 12' in the embodiment of FIG. 4. The impression cylinders 8, the entrance nip cylinders 17 and the exit nip cylinders 17', are rotatably journalled in the longitudinal beams 11', of the beam structure. The impression cylinders 8 and the entrance nip cylinders 17 in the beam structure 11 are arranged to be driven by means of an electric primary motor 21 via longitudinal drive shafts 22 and angle joints 23. The exit nip cylinders 17' are arranged to be driven by means of an electric motor 21'.

A jib arrangement 24 is provided on either side of the beam structure 11 and consists, for example, of cross bars 24', attached to the longitudinal beam 11', and a longitudinal bar 24". The jib arrangement 24 at one side of the beam structure 11 is also visible in FIG. 2. The jib arrangement 24 can, if required, be supported by pillars 12, as shown in FIG. 2.

Figure 5:
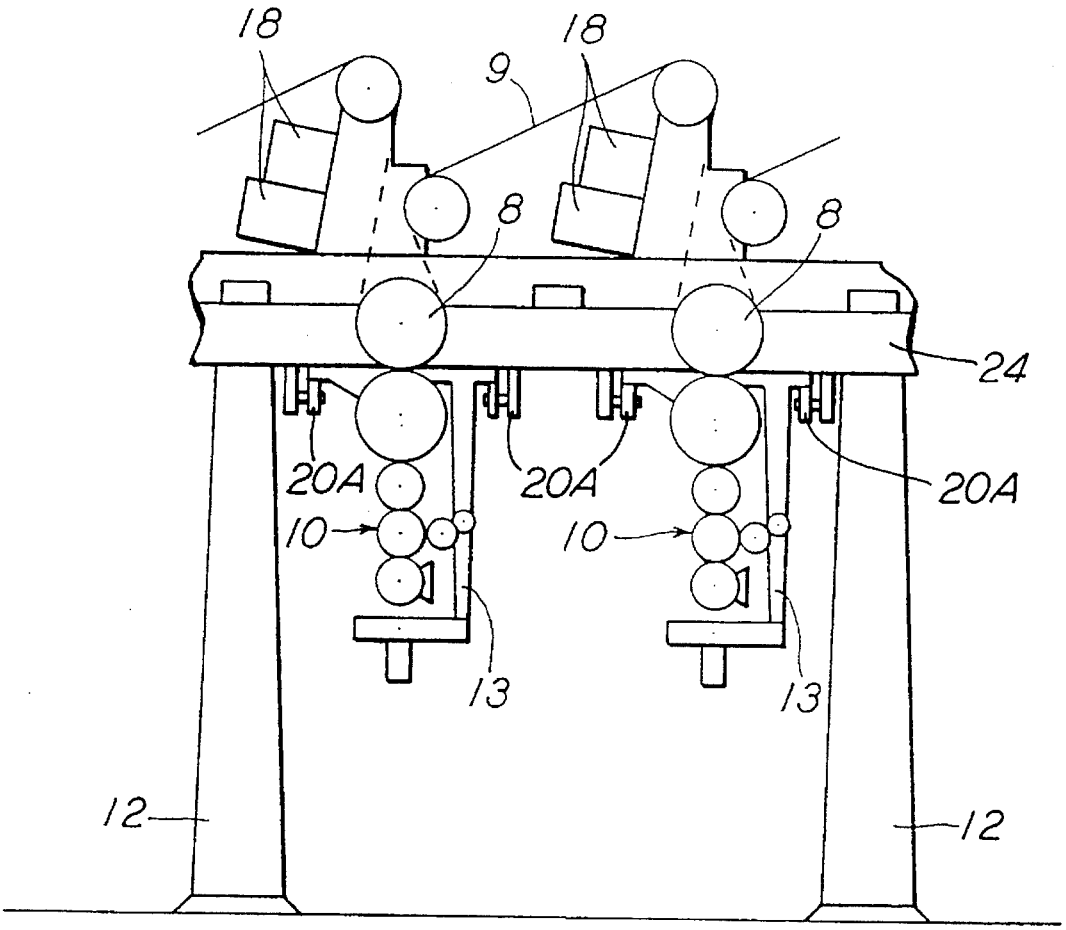
FIG. 5 is a partial side view of a printing press substantially as shown in FIG. 2 except that the printing units are supported on rollers or roller conveyors.

The brackets 20 mentioned above, and as shown in FIG. 2, or roller conveyors for the printing unit cassettes 10, 13, as shown in FIG. 5, are arranged at the lower side of the jib arrangement 24. As is apparent from FIG. 3, printing unit cassettes 10, 13 in one set can be pulled out to the right under the jib arrangement 24 for treatment or service after a previous print run in preparation for a coming print run, while at the same time, a second set of printing unit cassette 10, 13 can be positioned for printing under the impression cylinders 8. (For the sake of clarity, only one printing unit cassette 10, 13 is shown in printing position with a reference numeral in FIG. 3). When the printing is completed, the second set of printing unit cassettes 10, 13 can easily be brought out under the jib arrangement 24 to the left in FIG. 3, while the printing unit cassettes 10, 13 under the jib arrangement 24 to the right in FIG. 3, prepared for the coming printing, are brought into position for printing under the impression cylinders 8. An extremely short replacement time between different print runs can therefore be achieved, and accordingly a very high operating efficiency is also realized.

The system can be completed with an external handling system in the form of trolleys or a traverse for handling the printing unit cassettes 10, 13 either individually, or possibly even two or more at a time.

It appears clearly in FIG. 3 that the different cylinders in each printing unit cassette 10, 13 are connected to each other by means of the set of gearwheels. When the cassette is brought into its printing position under its impression cylinder 8, the uppermost gearwheel in this gearwheel set will be brought into engagement with a corresponding gearwheel of an output gearbox 25 on the outgoing shaft of the impression cylinder 8.

It should be observed that the beam structure 11 with the printing units 10, 13 arranged thereunder is the core of the construction and that the jib arrangements 24, while preferred, is not an essential element.

We claim:

1. A rotary printing press in which a web to be printed is caused to be conveyed via at least one rotating impression cylinder past a printing unit for printing on such web, said printing unit having a plurality of synchronous rotating cylinders including a plate cylinder adapted to press against such web passing intermediate said impression cylinder and said plate cylinder, the improvement comprising; a beam structure spaced above a floor area upon which said printing press is erected and from which said printing unit is suspended such that said floor area under said printing unit is devoid of any supporting structure.

2. A rotary printing press according to claim 1 in which a plurality of printing units are suspended from said beam structure, each adjacent to an impression cylinder.

3. A rotary printing press according to claim 1 in which said impression cylinder is rotatably mounted on said beam structure.

4. A rotary printing press according to claim 1 in which said beam structure is supported on said floor by means of pillars.

5. A rotary printing press according to claim 1 in which said beam structure is supported from columns extending downwardly from an overhead structure.

6. A rotary printing press according to claim 1 in which said printing unit is horizontally displaceable to said beam structure.

7. A rotary printing press according to claim 6 in which said printing unit is displaceably mounted on brackets.

8. A rotary printing press according to claim 6 in which said printing unit is displaceably mounted on roller conveyers.

9. A rotary printing press according to claim 1 in which said plurality of synchronous rotating cylinders within said printing unit are rotatably journalled within a frame structure.

10. A rotary printing press according to claim 1 in which said beam structure comprises a pair of longitudinal beams.

11. A rotary printing press according to claim 10 in which a plurality of crossbeams are provided extending transversely between said pair of longitudinal beams.

12. A rotary printing press according to claim 11 in which a jib arrangement is provided extending perpendicularly from at least one of said pair of longitudinal beams from which at least one printing unit can be movably suspended.

13. A rotary printing press according to claim 12 in which said jib arrangement comprises framework consisting of a plurality of cross bars extending perpendicularly from said at least one of said pair of longitudinal beams, and a longitudinal bar secured transversely to said cross bars.

14. A rotary printing press according to claim 12 in which a plurality of jib arrangements are provided extending perpendicularly from at least one of said pair of longitudinal beams each adapted to have one printing unit movably suspended therefrom.

15. A rotary printing press according to claim 12 in which said printing unit suspended from said jib arrangement is adapted to be moved laterally into position adjacent to an impression cylinder to replace a no longer needed printing unit removable from a side opposite said jib arrangement.

16. A rotary printing press according to claim 12 in which a jib arrangement is provided extending perpendicularly from each said pair of longitudinal beams, a first of which is adapted to support a replacement printing unit suspended therefrom, and a second of which is adapted to receive a printing unit to be replaced, such that said printing unit to be replaced can readily be moved to said second jib arrangement, and said replacement printing unit can be readily moved from said first jib arrangement into a position previously occupied by said printing unit to be replaced.

17. A rotary printing press according to claim 15 in which said first jib arrangement and said second jib arrangement are each adapted to support a plurality of printing units for purposes of replacing a plurality of printing units with a plurality of replacement printing units.

18. A rotary printing press according to claim 15 in which a plurality of said first jib arrangements and a plurality of said second jib arrangements are provided each adapted to support a printing unit for purposes of replacing a plurality of printing units with a plurality of replacement printing units.

19. A rotary printing press in which a web to be printed is caused to be conveyed via at least one rotating impression cylinder past a printing unit for printing on such web, said printing unit having a plurality of synchronous rotating cylinders including a plate cylinder adapted to press against such web passing intermediate said impression cylinder and said plate cylinder, the improvement comprising; a beam structure upon which said printing press is erected and from which said printing unit is suspended, said beam structure being supported from columns extending downwardly from an overhead structure.

20. A rotary printing press in which a web to be printed is caused to be conveyed via at least one rotating impression cylinder past a printing unit for printing on such web, said printing unit having a plurality of synchronous rotating cylinders including a plate cylinder adapted to press against such web passing intermediate said impression cylinder and said plate cylinder, the improvement comprising; a beam structure upon which said printing press is erected and from which said printing unit is suspended, said printing unit mounted on a roller conveyer and being horizontally displaceable to said beam structure.

* * * * *